United States Patent [19]

Weisbrod et al.

[11] Patent Number: 5,010,815

[45] Date of Patent: Apr. 30, 1991

[54] DOCTOR DEVICE

[75] Inventors: Norbert Weisbrod, Hessheim; Norbert Köbler, Beindersheim, both of Fed. Rep. of Germany

[73] Assignee: Albert-Frankenthal AG, Frankenthal, Fed. Rep. of Germany

[21] Appl. No.: 290,152

[22] Filed: Dec. 27, 1988

[30] Foreign Application Priority Data

Jan. 9, 1988 [DE] Fed. Rep. of Germany ..... 3800411

[51] Int. Cl.[5] ..... B41F 7/02

[52] U.S. Cl. ..... 101/217; 15/256.51; 101/169; 101/363; 118/261

[58] Field of Search ..... 101/169, 152, 216, 217, 101/350, 363, 365; 15/256.51; 118/261

[56] References Cited

U.S. PATENT DOCUMENTS

| | | | |
|---|---|---|---|
| 3,986,453 | 10/1976 | Bööse | 101/169 |

FOREIGN PATENT DOCUMENTS

| | | | |
|---|---|---|---|
| 110081 | 6/1984 | European Pat. Off. | 101/169 |
| 2538908 | 3/1977 | Fed. Rep. of Germany | 101/169 |
| 1164098 | 10/1958 | France | 101/169 |
| 693187 | 6/1953 | United Kingdom | 15/256.51 |
| 800607 | 8/1958 | United Kingdom | 15/256.51 |

*Primary Examiner*—Edgar S. Burr
*Assistant Examiner*—Moshe I. Cohen
*Attorney, Agent, or Firm*—Edwin D. Schindler

[57] ABSTRACT

In the context of an ink doctor arrangement with at least one doctor blade which is arranged to be carried on a doctor blade mount more reliable operation with less wear and is made possible by arranging the blade loosely in a slot in the said mount.

4 Claims, 1 Drawing Sheet

DOCTOR DEVICE

BACKGROUND OF THE INVENTION

The invention relates to a doctor unit for a printing press with at least one doctor blade arranged to be carried on a doctor mount;

In the prior art the doctor blade is firmly gripped in the mount. The consequence of such a method of fixing is that the gripped part of the blade, which during operation is heated to a considerable extent is not able to expand laterallY. and this causes part of the blade which is not gripped to become corrugated where it engages the cYlinder to be wiped bY the blade. In order to nevertheless avoid an uneven engagement of the doctor blade on the cylinder to be Wiped it has thus been necessary to use a substantial force to apply the blade to the cylinder and this led to rapid wear of the doctor blade something that in turn led to the necessitY cf frequent resetting and replacement of the blade. Known arrangements accordingly are not sufficiently simple to operate and are insufficiently economic. The above disadvantages make themselves particularly felt in connection with offset lithe ink systems, because the high ink viscosity leads to a very pronounced heating of the doctor

SHORT SUMMARY OF THE INVENTION

Taking this state of the art as its starting point, one object of the invention is to so imProve a doctor arrangement of the initiallY described type using simple and cheap means that reliable operation is ensured.

A further object of the invention is to avoid extreme loading or wear of the doctor blade.

In order to achieve these or other aims in the invention the doctor blade is able to be loosely mounted in a slot therefor in the doctor mount.

This ensures on the on a hand that the doctor blade or blades is or are able to expand in the lateral direction sc that even if they are applied to the cylinder with a low force so as to ensure low gear, there is a reliable engagement of the blade on the cylinder to be wiped. This is particularly advantageous in those cases in which high viscosity inks, such as lithe inks, are being handled which maY lead to a considerable heating of the doctor blade or the doctor blades.

In this respect it is an advantage if the clearance width of the blade slot, which preferably extends the full length of the blade mount, has an oversize of 3/100 to 4/100 mm, i.e. it exceeds the thickness of the blade by this amount. This feature ensures reliable support of the doctor blade despite the intended possibility of expansion.

It is an advantage if the blade slot is delimited by a rail carried on a stepped recess in the doctor blade mount. This feature ensures simple production of the blade slot.

In the case of a doctor with an ink chamber defined by two doctor blades and an ink receiving space walled off at the ends by sealing bars it is an advantage if the sealing bars are arranged so as to give way in the longitudinal direction of the doctor blades and are preferably provided with spring means in order to urge them against the blades. This ensures that in the case of expansion of the doctor blades the sealing bars are able to give way so that in this case as well it is possible to avoid corrugation of the doctor blades.

Further advantageous features of the invention will be seen from the claims and from the following account of one working example of the invention.

LIST OF THE FIGURES OF THE DRAWING

DETAILED DESCRIPTION OF WORKING EMBODIMENT OF THE INVENTION

Figure 1:
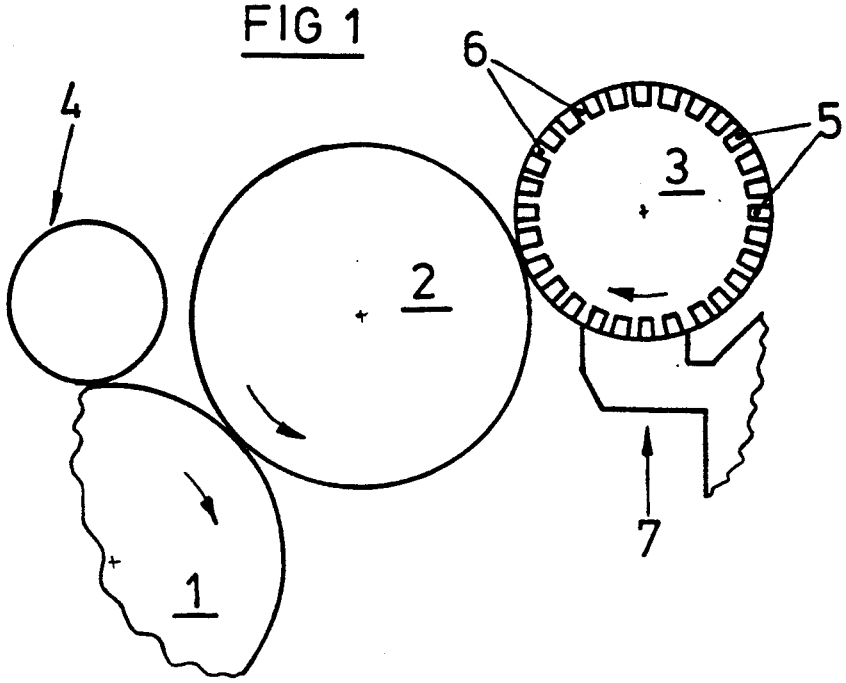
FIG. 1 is a diagrammatic view of an offset litho press inking unit ensuring a short ink path from the fountain to the surface of the plate cylinder.

The inking unit of FIG. 1, which ensures a short path of the ink from the ink chamber to the plate cylinder, and is thus referred to as a short inking unit, comprises a rubber coated form roll 2 running on the plate cylinder 1. The form roll 2 is supplied with ink bY a pitted roll 3 and with dampening liquid by a dampening unit 4. The periphery of the pitted roll 3, which may have a ceramic coating is provided with pits 5, shown on an exaggerated scale, and lands 6 delimiting the pits from each other. The pits 5 are filled with ink. The lands 6 are wiped clean by the doctor blade.

Figure 2:
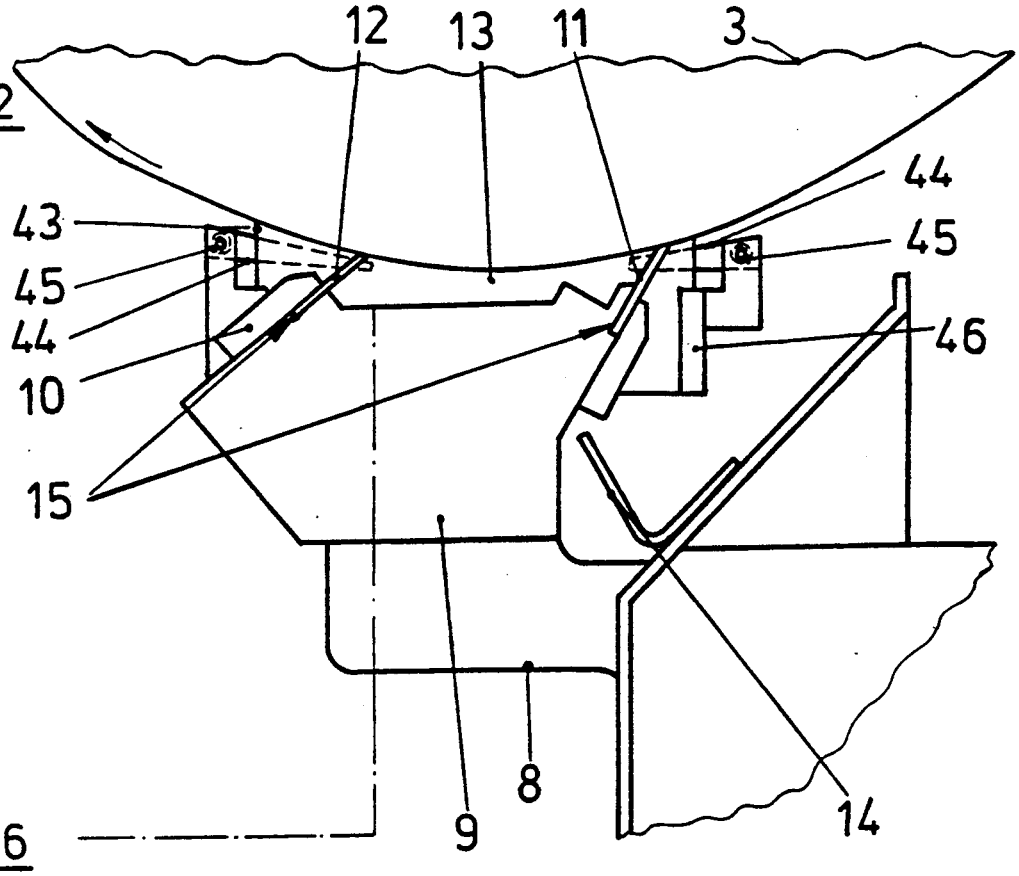
FIG. 2 is a section through a doctor with an ink chamber using two loosely mounted doctor blades.

The supply of ink to the pitted roll 3 and the wiping of the lands 6 is carried out in the present case bY an ink chamber doctor generally referenced 7 in FIG. 1. This doctor comprises, as will be seen from FIG. 2, a bar-like doctor mount g, carried on carriers 8 secured to the frame of the press and two doctor blades II and 12 which are carried on the mount 9 and are mutually offset from each other in the direction of rotation of the pitted roll. The doctor blades define an ink receiving chamber 13 between them which is fed with offset litho ink by a pump 16. The rear blade 11 in the direction of rotation of the Pitted roll 3 acts as the front doctor which has a gutter 14 under it. The other doctor blade 12 acts as the chamber closing blade. Both the doctor blades are set at a negative angle to the roll 3 in the illustrated example of the invention.

The doctor blades 11 and 12. Which oWing to the high viscosity of the offset ink are considerably heated, are loosely mounted in the doctor mount 9, that is to saY without anY clamping effect. The mount 9 is provided with blade receiving slots 15 extending along its full length. For this purpose the doctor mount 9 is provided at its sides with respective stepped recesses which are respectivelY shut off by a rail 10, carried on the doctor mount 9, so that a groove-like blade receiving slot 15 is defined. The clearance width of the blade slot 15 has an oversize of 3/100 to 4/100 mm.

The doctor blades 11 and 12 also extend along the full length of the doctor mount 9. At the ends of the doctor mount 9 the ink receiving chamber 3 is delimited by sealing bars 43 resting on the periphery of the pitted roll 3 and the ends of the doctor blades 11 and 12. The sealing bars 43 are formedly a piece of sheet metal whose sides are taken up in guides 46 formed on the doctor mount 9. The clearance width of the guides 46 is made with such an oversize in relation to the thickness of the sealing bars 43 in the longitudinal direction of the doctor blades 11 and 12 that when the doctor blades 11 and 12 expand it is possible for the sealing bars to give way to a suitable extent. The sealing bars 43 are urged resiliently against the ends of the doctor blades 11 and 12, for which purpose the sealing bars, where they engage the ends of the doctor blades, have finger-like supports 44 fitting behind them, which resiliently bear against the doctor mount 9 in the length direction of the doctor blades 11 and 12, this being indicated at 45.

We claim:

1. A doctor arrangement for wiping excess ink from a pitted cylinder forming a part of an off set press inking unit, comprising:

at least one doctor blade; and, a blade mount having a slot extending along the length of said blade mount in which said blade is loosely fitted, said slot having a clearance width with an oversize with respect to the thickness of said doctor blade, the oversize amounting to 3/100 to 4/100 mm, said arrangement being entirely devoid of any other structure which tends to grip said doctor blade in said slot.

2. The doctor arrangement as claimed in claim 1 wherein the blade slot in the blade mount is delimited by a rail arranged to be carried in a stepped recess in the blade mount.

3. The doctor arrangement as claimed in claim 1 comprising at least two of said doctor blades of which at least one of said doctor blades to the rear, in terms of the direction of rotation of the cylinder, is set loosely in a blade receiving slot in said blade mount and is set at a negative angle to the cylinder.

4. The doctor arrangement as claimed in claim 3 comprising sealing bars engaging the ends of said doctor blades in yielding and resilient manner.

* * * * *